US005655946A

United States Patent [19]

Harris et al.

[11] Patent Number: 5,655,946

[45] Date of Patent: Aug. 12, 1997

[54] SIMULATED FEEDING APPARATUS AND METHOD

[75] Inventors: Peter M. Harris, Buffalo; Charles W. Paddock, Lancaster, both of N.Y.

[73] Assignee: Fisher-Price, Inc., East Aurora, N.Y.

[21] Appl. No.: 696,638

[22] Filed: Aug. 14, 1996

[51] Int. Cl.[6] ..... A63H 3/52; A63H 3/24

[52] U.S. Cl. ..... 446/304; 446/479

[58] Field of Search ..... 446/304, 305, 446/321, 268, 236, 479; 472/57, 71

[56] References Cited

U.S. PATENT DOCUMENTS

| | | | |
|---|---|---|---|
| 3,202,423 | 8/1965 | Becker . | |
| 4,159,594 | 7/1979 | Reiner et al. . | |
| 4,565,537 | 1/1986 | Klimpert et al. | 446/321 |
| 5,118,321 | 6/1992 | Greenberg et al. | 446/304 |

*Primary Examiner*—Mickey Yu

*Attorney, Agent, or Firm*—Morgan, Lewis and Bockius, LLP; C. Scott Talbot

[57] ABSTRACT

An apparatus and method for simulating the feeding of a variety of food types to a child's baby doll is disclosed. The apparatus includes a spoon and a food container. The food container is segmented into three compartments, each of which contains a different simulated food type. Within each compartment is a cam assembly for interaction with a cam follower that is disposed within a spindle that is rotatably mounted within the bowl of the spoon. The outer surface of the spindle is configured to also represent food, where the types of food represented on the spindle in the bowl of the spoon are the same food types that are simulated in the food container. When a child inserts the spoon into the food container, if the food displayed in the bowl of the spoon is not the same food type as that into which the spoon is inserted, the cam follower in the spindle interacts with the cam in the food container to rotate the spindle such that upon extraction of the spoon from the food container, the bowl of the spoon now appears to contain within it the same type of food as that into which it was inserted.

14 Claims, 13 Drawing Sheets

SIMULATED FEEDING APPARATUS AND METHOD

BACKGROUND OF THE INVENTION

The invention relates to a child's toy meal set that provides for simulating feeding of a child's toy doll. More specifically, the invention relates to a child's meal set that provides for the simulated feeding of a variety of food types to a doll through interaction between the spoon and the food container of the meal set.

A variety of toy feeding apparatuses are known that enable a child to simulate the feeding of food to a doll.

U.S. Pat. No. 4,159,594 discloses a toy feeding spoon for use with a baby doll that contains a magnet. The magnet in the spoon cooperates with both a magnet mounted in a simulated food container and with a magnet mounted in the mouth of a baby doll. The magnet in the spoon cooperates with the magnet in the food container to change the configuration of the spoon from one where the spoon appears empty prior to insertion into the container to one where the spoon appears to contain "food" on it after removal from the container. To achieve this effect, the spoon contains a flat, circular, rotatable disk in its bowl. The disk is configured such that the magnet is mounted on its underside and on its opposite side food is present on one half of the disk and food is absent on the other half. A cover is located above the bowl of the spoon to obscure one-half of the bowl of the spoon from view and, consequently, one-half of the rotatable disk in the bowl is also obscured from view. The interaction of the magnet in the food container and the magnet on the rotatable disk rotates the disk such that the half of the disk with no food on it is positioned under the cover, and thus out of view of an observer, and the half of the disk with food on it is viewable in the uncovered half of the bowl of the spoon. In this manner a portion of the bowl of the spoon appears to contain food in it. To simulate feeding of a toy doll, the spoon is placed near the mouth of a doll that also contains a magnet within it. The interaction of the magnet in the spoon with the magnet in the doll's mouth rotates the disk so that now the half of the disk with no food on it appears in the viewable portion of the bowl of the spoon and the half that contains the food on it is positioned under the cover. Through this interaction with the doll, the food appears to have been eaten by the doll.

U.S. Pat. No. 5,118,321 also discloses a spoon that interacts with a food dish so that an empty spoon that is inserted into the dish appears to contain food on it when it is removed from the dish. The spoon is comprised of a hollow handle that retains a mechanism within it, out of view of an observer, that contains "food" on one end of the mechanism. After the spoon is inserted into the dish, and as it is being removed from the dish, a protrusion on the dish engages a protrusion on the food mechanism that is disposed within the hollow handle of the spoon to urge the food mechanism from its position within the hollow handle to a position where the food portion of the mechanism is now observable in the bowl of the spoon. To simulate feeding of a doll, as the spoon is inserted into the doll's mouth, the mouth releases the food mechanism from its extracted position in the bowl of the spoon. The food mechanism is then retracted back into the hollow handle of the spoon.

Both of these patents only disclose a spoon that changes its configuration from one where the spoon appears to contain food on it to one where the spoon appears to be empty. No provision is made for varying the type of food that is present on the spoon. Further, the mechanisms disclosed in the above-referenced two patents for changing the state of the spoon (i.e. empty vs. full) have drawbacks. The operation of the magnet mechanism as disclosed in the '594 patent can be affected during the course of play by obscuration of the magnet by foreign objects and/or through interference from other nearby ferromagnetic materials, thus rendering the magnet ineffective for changing the configuration of the spoon. The spring-biased, latched mechanism as disclosed in the '321 patent is relatively complex and susceptible to wear or damage during play by young children.

Therefore, it would be desirable to provide a toy feeding apparatus that could both provide for simulating the feeding of a variety of food types to a baby doll and which utilizes a simple, robust mechanism for changing the food type displayed on the spoon. In this manner, a child user could more realistically simulate feeding a baby. The child could pretend that the baby is receiving a nutritious meal of various foods that the child has prepared for baby, the baby could be imagined to put up a fuss when the child attempts to feed the baby food that it doesn't like, such as "peas", and the child could treat the baby with a special dessert when baby finishes its peas and carrots. The simple mechanical device for changing the food type displayed on the spoon of the present invention is easy to operate by a child and is durable so as to provide for extended use.

SUMMARY OF THE INVENTION

The drawbacks of the toy feeding apparatuses in the prior art are overcome by the present invention which includes an apparatus and method for simulating the feeding of a variety of food types to a toy doll. Through use of the present invention, a child is able to simulate the feeding of a variety of food types to a baby doll which adds to the enjoyment of pretending to feed the doll. The mechanism for changing the type of food displayed on the spoon is a simple, mechanical device that is both easy to operate and durable.

In accordance with the present invention there is provided a child's meal set which includes a spoon assembly and a food container. The spoon assembly is comprised of a handle and a bowl portion that contains a rotating spindle within the bowl portion. The spindle is configured such that there are multiple regions, integrally formed with the spindle, that extend around the outer periphery of the spindle. Each of these regions is formed so as to appear to be comprised of a different food type, e.g. peas, carrots, and cereal. The food container is configured such that it is comprised of multiple compartments such that each compartment appears to contain a different food type. For example, the food container could be segmented into thirds to give the appearance that three different food types are present in the container. The quantity and type of food displayed in the food compartments in the food container corresponds with the quantity and type of food regions on the spindle, e.g. representing peas, carrots, and cereal.

The spindle is mounted in the bowl of the spoon for rotation such that upon rotation, one of the food regions formed on the outer periphery of the spindle will appear in the opening of the bowl of the spoon. In order to achieve rotation of the spindle, the spindle contains a cam follower surface that mates with a cam in the food container when the spoon is inserted into a spoon recess in a food compartment of the food container. As the spoon is inserted into a particular compartment of the food container, the cam in the recess interacts with the cam follower surface of the spindle to rotate the spindle. The cams in each food container compartment are oriented to rotate the spindle such that as the spoon is removed from the container, the opening in the bowl of the spoon displays the same type of food as is in the compartment that the spoon was inserted into, To display a different food type within the bowl opening of the spoon, the spoon is inserted into a different compartment of the container. Through rotation of the spindle to another position by interaction of the cam follower surface with the cam in the compartment, a different food region of the spindle now appears in the opening of the bowl, creating the appearance that the spoon contains food on it from the new compartment.

DETAILED DESCRIPTION

Figure 1:
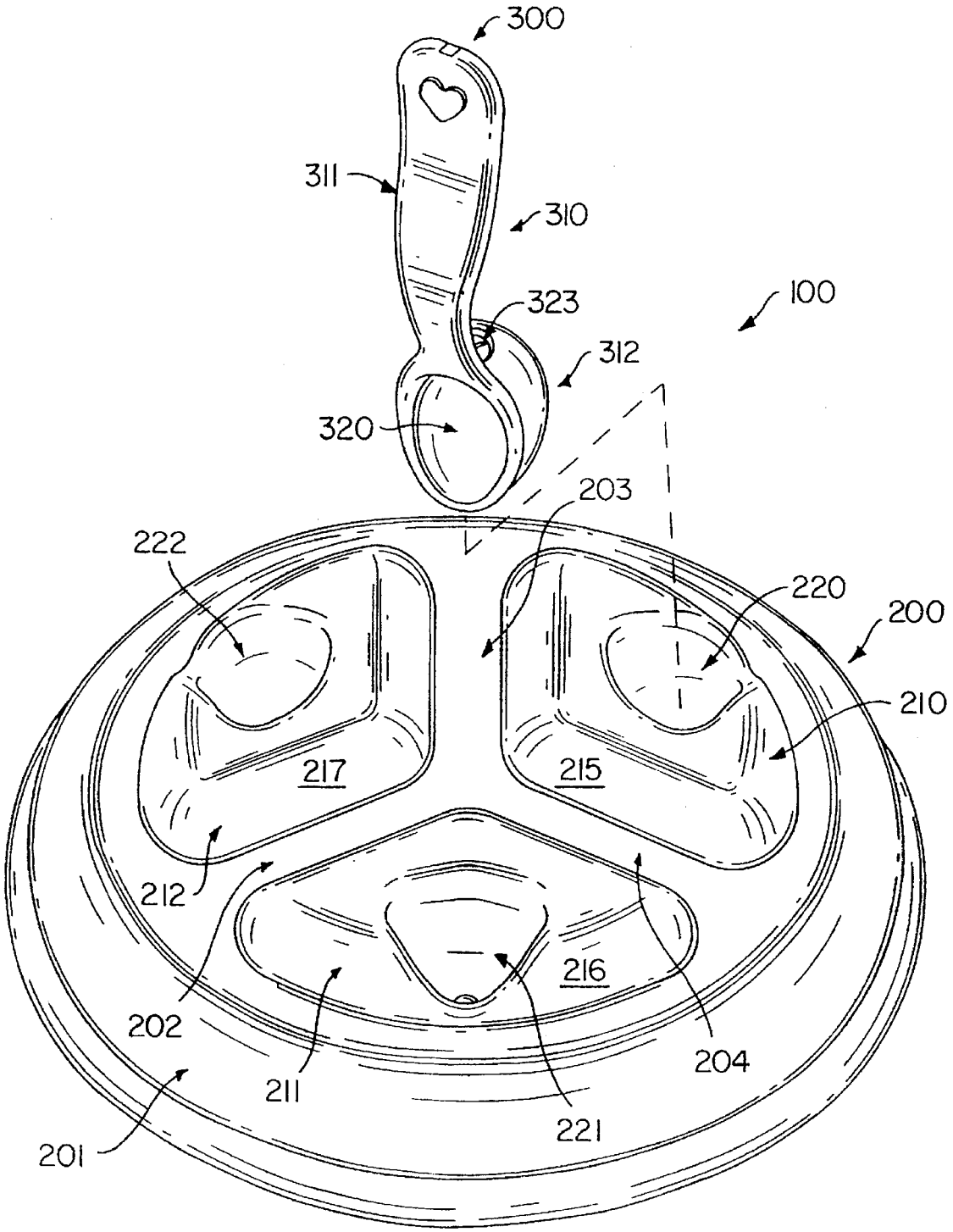
FIG. 1 is a perspective view of a child's meal set.

As illustrated in FIG. 1, the child's meal set 100 includes a food container 200 and a spoon assembly 300 that operatively interacts with the food container 200.

Figure 3A:
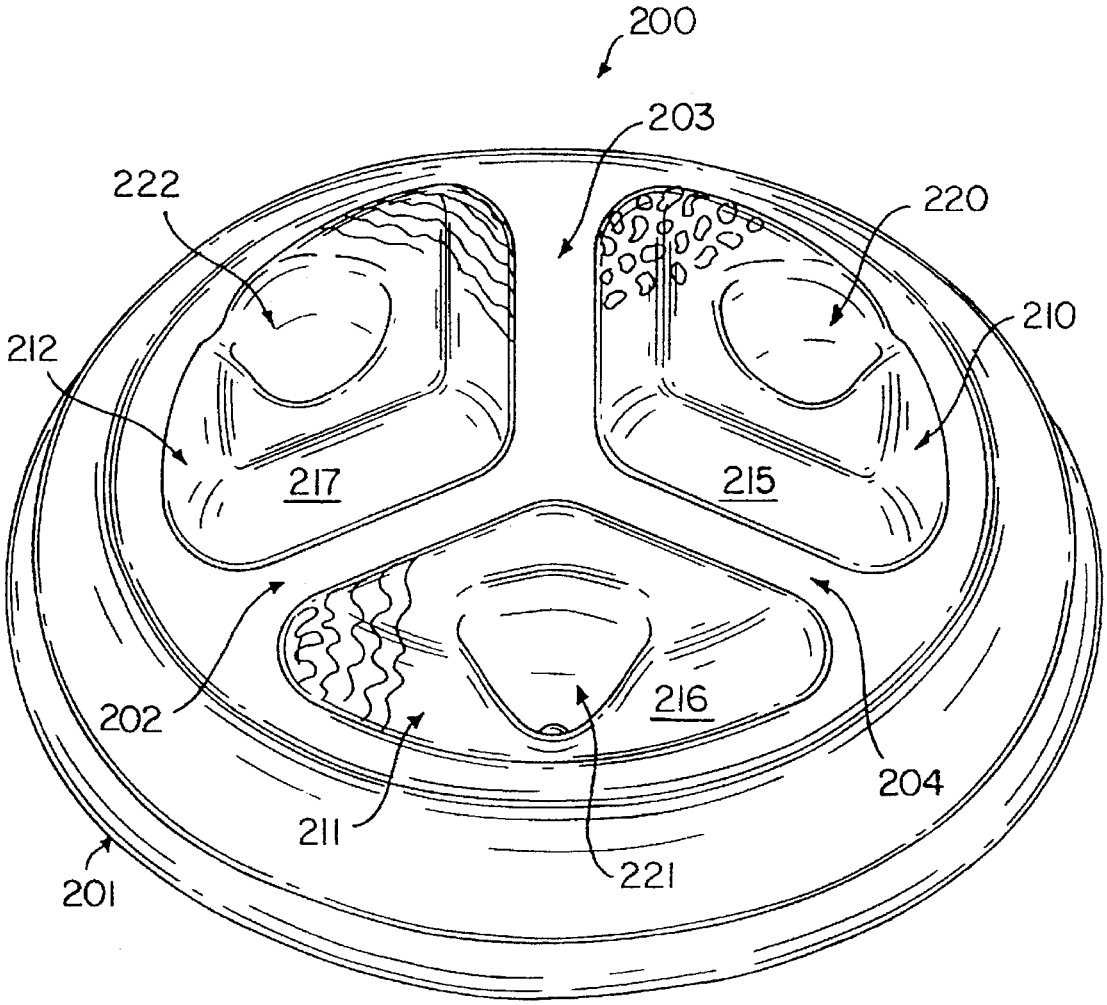
FIG. 3A is a perspective view of the food container of FIG. 1.
Figure 3B:
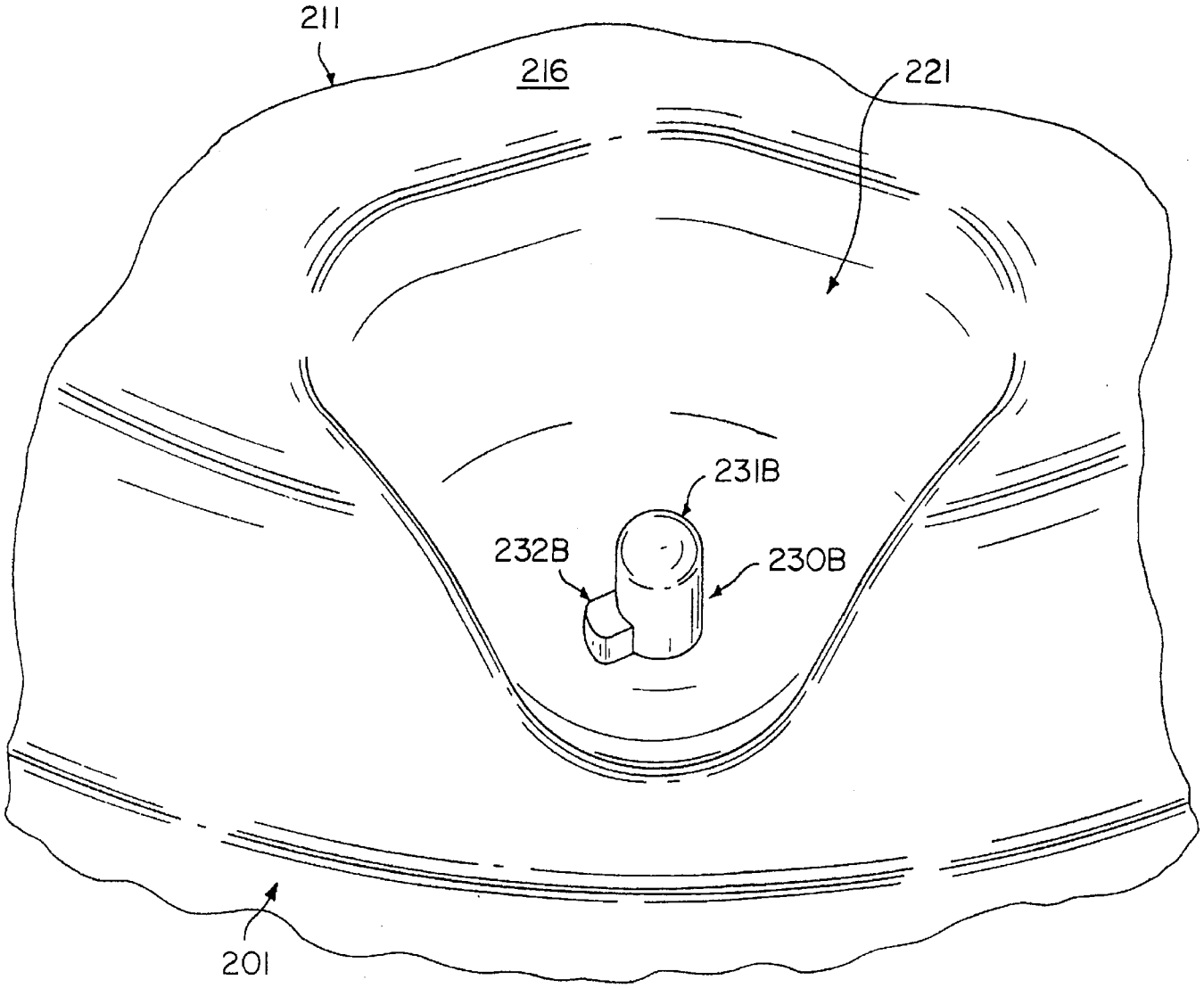
FIG. 3B is a detail perspective of one spoon recess of the food container of FIG. 3A.
Figure 3C:
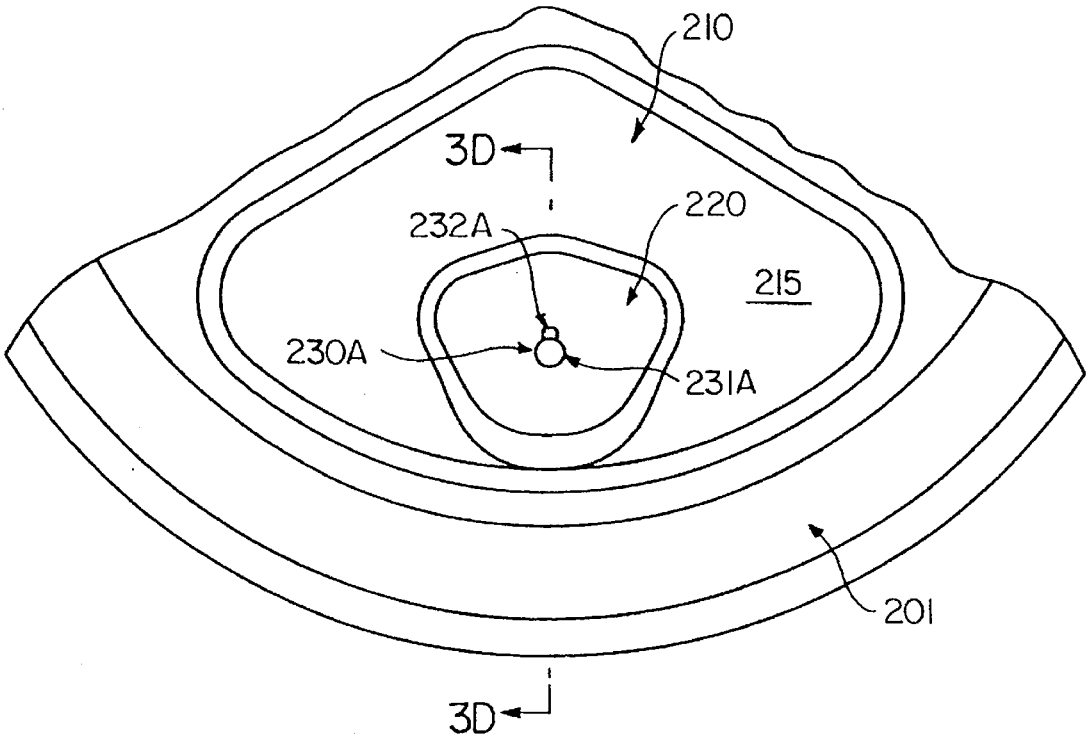
FIG. 3C is a top view of one spoon recess of the food container of FIG. 3A.
Figure 3D:
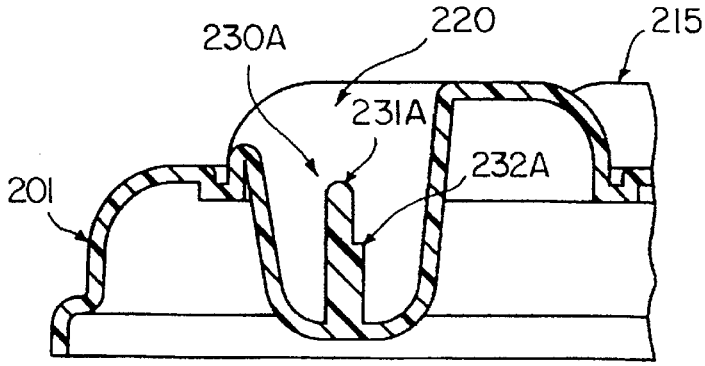
FIG. 3D is a cross-sectional view of the cam guide and cam along the line 3D—3D of FIG. 3C.
Figure 3E:
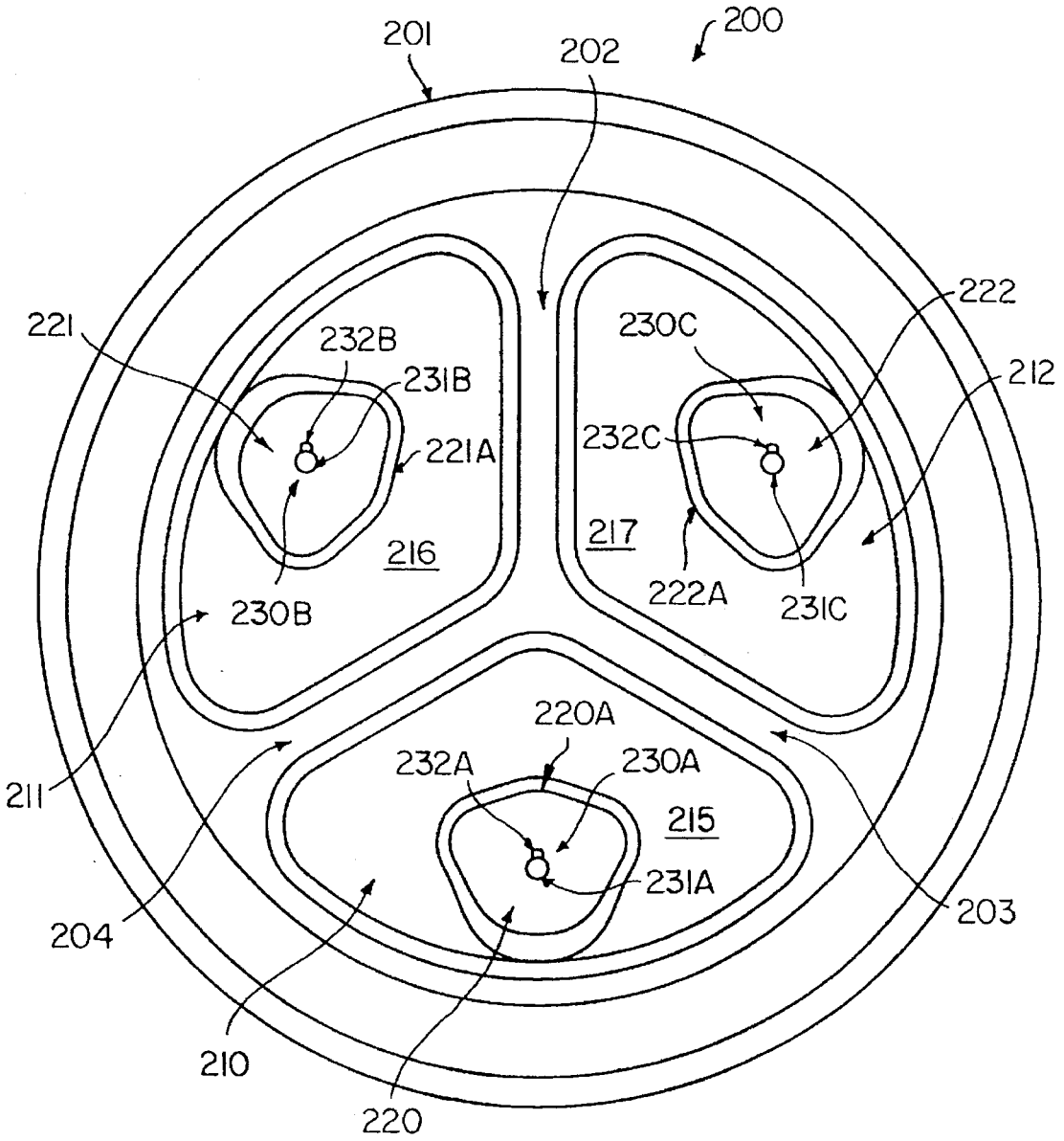
FIG. 3E is a top view of the food container of FIG. 3A.

As shown in FIGS. 1, 3A and 3E, food container 200 comprises an outer frame 201 and three compartment separators 202, 203, and 204. The compartment separators 202, 203, and 204 serve to segregate the food container 200 into three food compartments 210, 211, 212. Each of the food compartments 210, 211, and 212 contain simulated food (simulated peas 215, carrots 216, and cereal 217, respectively), which is integrally molded with the food container 200. To achieve a distinct appearance for each of the food types, each food type is formed with a different surface configuration or texture and a different color.

The food compartments 210, 211, 212 of the food container 200 each contain a spoon recess 220, 221, and 222, respectively. The spoon recesses 220, 221, and 222 are configured to receive within them the spindle 320 of the spoon assembly 300. The spoon recesses 220, 221, and 222 are formed and positioned identically within the food compartments 210, 211, and 212 such that the spindle 320 can only be fit into the spoon recess in a single orientation. The spoon recesses 220, 221, and 222 of the food container 200 each contain cam assemblies 230A, 230B and 230C as best seen in FIGS. 3B–3E disposed in the bottom of the spoon recesses. The cam assemblies 230A, 230B, 230C are comprised of cam guides 231A, 231B, 231C, and cams 232A, 232B, 232C, respectively. The guides extend upwardly from the top of their respective cams and from the bottom of the spoon recesses. As shown in FIG. 3E, with reference to an axis defined by the cam assemblies 230A, 230B and 230C and the inner most protrusions 220A, 221A and 222A of the spoon recesses, each cam 232A, 232B, 232C is positioned within the spoon recess in a different orientation.

Figure 2A:
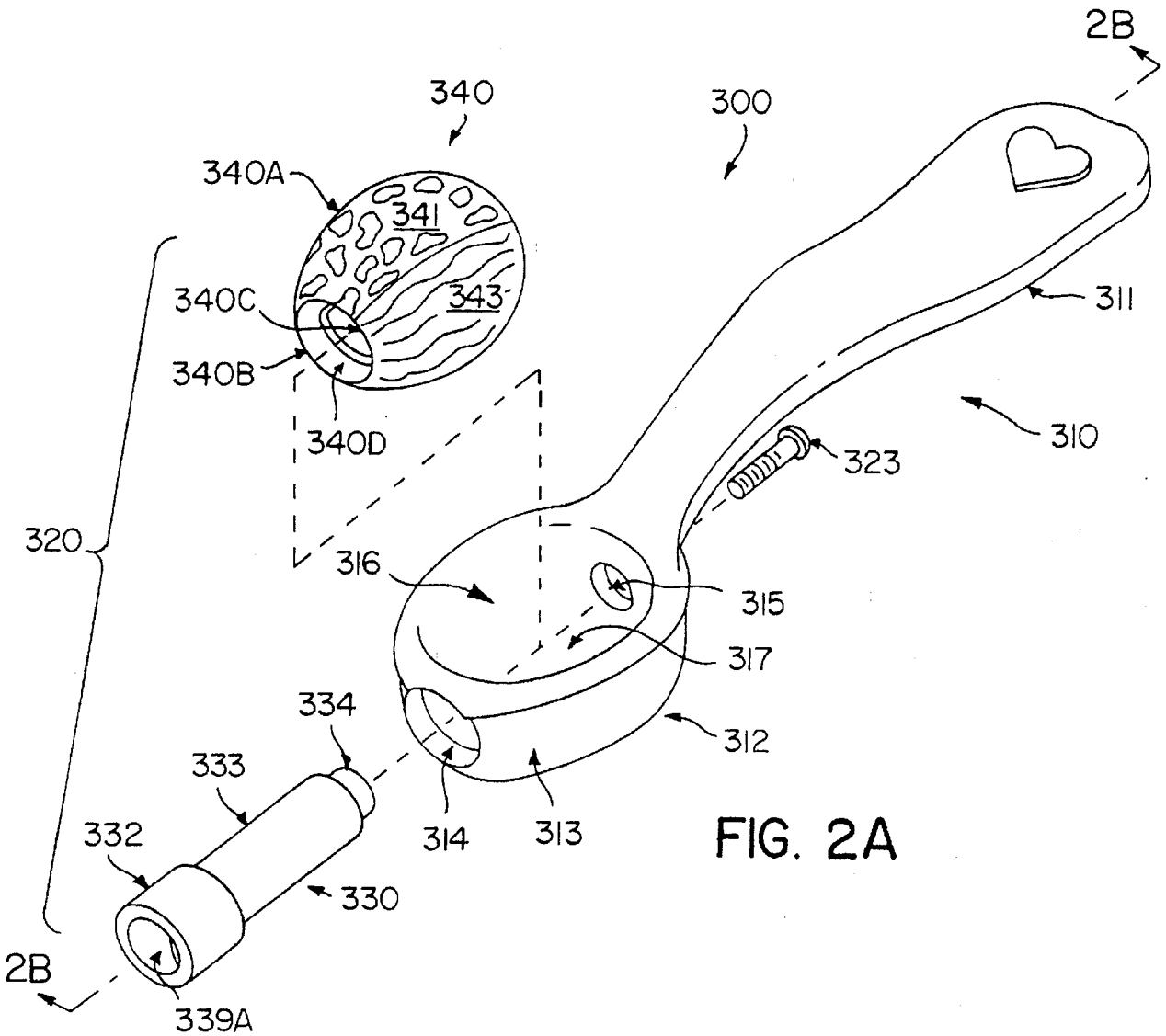
FIG. 2A is an exploded perspective view of the spoon assembly of FIG. 1.
Figures 2B, 2C:
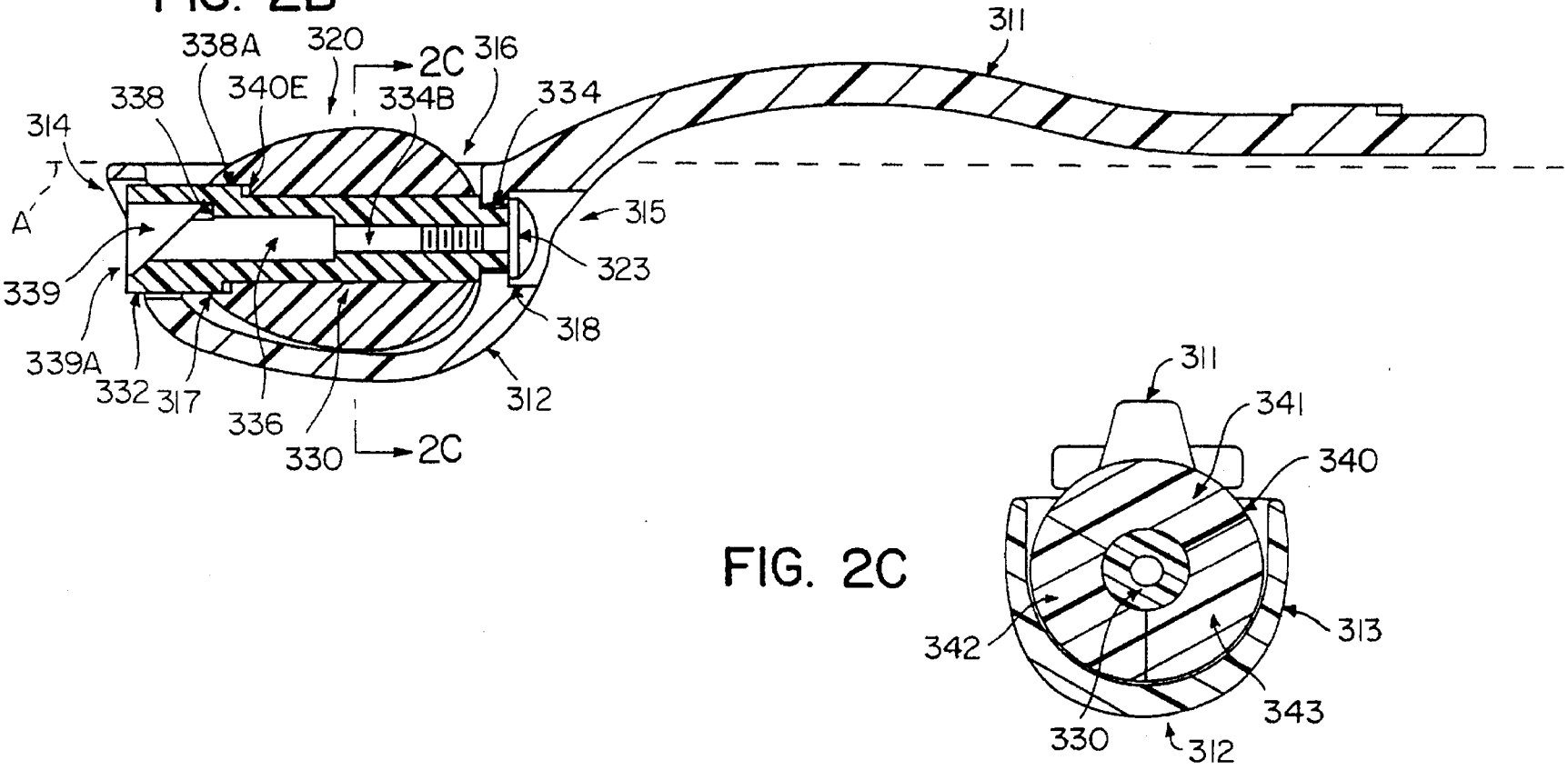
FIG. 2B is a cross-sectional view of the spoon assembly taken along the line 2B—2B of FIG. 2A.
FIG. 2C is a cross-sectional view of the spoon assembly taken along the line 2C—2C of FIG. 2B.

As shown in FIG. 2A, the spoon assembly 300 includes a spoon body 310 and a spindle 320. The spindle 320 includes a spindle core 330, and a food cylinder 340. The spoon body 310 has a handle portion 311 and a bowl portion 312. The bowl portion has a peripheral sidewall 313 bounding a spindle cavity 317 and having a food viewing opening 316 and front and rear spindle journal openings 314 and 315, respectively. Rear journal opening 315 is bounded by a peripheral shoulder 318, as shown in FIG. 2B. For purposes of reference herein, as shown in FIG. 2B, spoon assembly 300 is considered to have a longitudinal axis A lying in the plane of symmetry of the spoon assembly and approximately parallel to the plane of the rim of the food viewing opening 316.

Figure 2D:
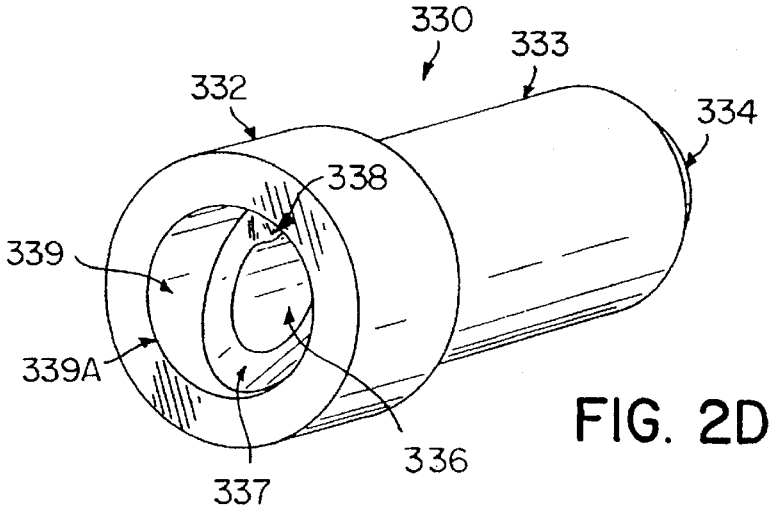
FIGS. 2D, 2E, and 2F are perspective, front, and side views of the spindle core of FIG. 2A.
Figure 2E:
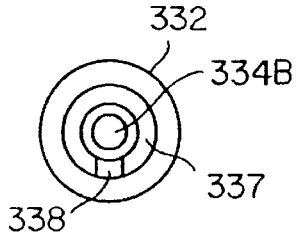
Figure 2F:
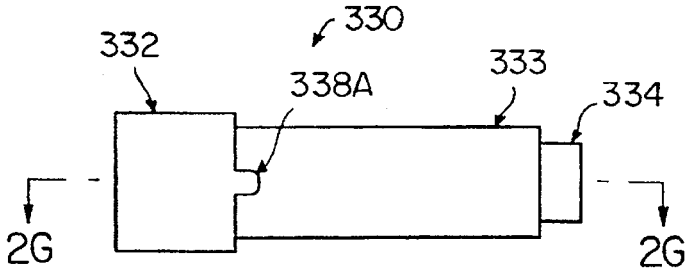
Figure 2G:
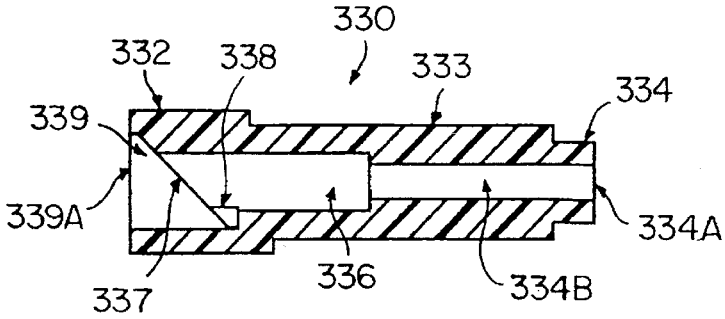
FIG. 2G is a cross-sectional view of the spindle core taken along the line 2G—2G of FIG. 2F.

As best seen in FIGS. 2D–2G, the spindle core 330 is a hollow cylinder with a stepped bore and a stepped outside diameter. The spindle core can be divided longitudinally into three portions with corresponding outside diameters: a largest-diameter spindle head portion 332; an intermediate-diameter spindle body portion 333; and a smallest diameter spindle fastener portion 334. The inner bore of the spindle core 330 is stepped to form three bore portions with three inside diameters: the smallest-diameter spindle fastener bore 334B opens at one end at spindle fastener aperture 334A and traverses spindle fastener portion 334 and part of spindle body portion 333; intermediate-diameter cam guide receiving bore 336 traverses the remainder of spindle body portion 333 and part of spindle head portion 332; and largest-diameter cam receiving bore 339 traverses the remainder of spindle head portion 332, terminating in a cam receiving aperture 339A. The shoulder formed by the transition in diameters between cam receiving bore 339 and cam guide receiving bore 336 defines a cam follower surface 337. As seen in FIGS. 2D and 2G, the cam follower surface 337 is oriented at a 45° angle with respect to the longitudinal axis of the spindle core 330. The cam follower surface 337 includes a cam receiving notch 338 formed at the end of the cam follower surface farthest from cam receiving aperture 339A. On the outside surface of the spindle core, as shown in FIG. 2F, a tab 338A is formed to provide additional structure in the shell of the spindle core at a point where the cam receiving notch 338 is located within the spindle core and to properly index the food cylinder on the spindle core.

As shown in FIGS. 2A–2C, food cylinder 340 is an egg-shaped hollow cylinder with a stepped bore and a convex outer surface. The outer surface 340A of food cylinder 340 is segregated into three distinct food regions 341, 342, 343, each spanning 120° about the longitudinal axis of the cylinder. Each food region is configured to visually simulate a different type of food. The food regions 341, 342, and 343 are formed with the same surface configuration/texture and same color as the simulated food 215, 216, and 217, respectively, that is displayed in food compartments 210, 211, 212. As such, food regions 341, 342, and 343, and simulated food 215, 216, and 217, are configured to represent the same types of foods, respectively, e.g. peas, carrots, and cereal. The bore 340B of food cylinder 340 has a smaller diameter portion 340C sized to receive spindle body portion 333 and a larger diameter portion 340D sized to receive spindle head portion 332. A notch 340E is formed at the shoulder between the two bore portions and is sized to receive tab 338A.

Spindle 320 is thus formed by inserting spindle core 330 into food cylinder 340, oriented so that notch 340E of food cylinder 340 engages tab 338A of spindle core 330. There is therefore a predetermined angular orientation of the food regions with respect to cam follower surface 337 and cam receiving notch 338.

Referring to FIGS. 2B and 2C, spindle 320 is mounted within spindle cavity 317 of bowl portion 312 with spindle fastener portion 334 of the spindle core 330 fitted into the rear spindle journal opening 315 and with spindle head portion 332 of spindle core 330 fitted into the front spindle journal opening 314 of bowl portion 312. A fastener 323, which in the illustrated embodiment is a screw, rotatably secures spindle 320 in bowl portion 312. The threaded shaft of fastener 323 is inserted into, and engages, spindle fastener bore 334B, while the head of fastener 323 engages peripheral shoulder 318. Spindle 320 is thus supported for rotation in the front and rear journals, and its longitudinal movement is restrained by engagement of fastener 323 with shoulder 318. There is frictional engagement between the spindle head portion 332 and front journal 314 such that the spindle 320 is not able to free-wheel within the bowl portion 312 but yet is able to be rotated with a minimal application of force. This force may be applied through a variety of means, including force applied by a child's finger or through operative interaction of the cam follower surface of the spindle and the cams disposed in the spoon recesses, as will be explained.

Spindle 320 rotates within the bowl portion 312 such that in the food viewing opening 316, there appears one of the food regions 341, 342, or 343. For example, when food region 341 appears in food viewing opening 316, food regions 342 and 343 are disposed within the bowl portion 312 and are not viewable. Thus, it appears that the bowl portion 312 of the spoon assembly 300 contains the particular type of food in it that food region 341 is configured to represent, namely peas.

As discussed previously, spindle 320 of the spoon assembly 300 may be rotated through a variety of means, one of which is through operative interaction with the cam assemblies of the food container 200. The interaction between spindle 320 and the cam assemblies of the food container 200 is designed to operate such that, upon insertion, and after removal of the spoon assembly 300 from any of the spoon recesses 220, 221, 222, the food region that is displayed in the food viewing opening 316 is of the same configuration, i.e. same food type, as that which is represented by the simulated food 215, 216, 217 in the food compartments 210, 211, 212. For example, food regions 341, 342, and 343, configured as peas, carrots and cereal, respectively, are configured to have the same surface configuration and color as the simulated food 215, 216, and 217 which is contained in the food compartments 210, 211, and 212, respectively. Therefore, if the spoon assembly 300, upon insertion into spoon recess 220 of food compartment 210, which contains simulated food 215, configured as peas, does not display food region 341, also configured as peas, in the food viewing opening 316, the interaction of the cam assembly 230A and the spindle core 330 will rotate the spindle 320 such that upon removal of the spoon assembly 300 from the spoon recess 220, food region 341, representing peas, will now be displayed in the food viewing opening 316. In this manner, whenever the spoon assembly 300 is placed into container 200 and removed, the food region that is displayed in the food viewing opening 316 will always be the same type of food as that into which it was inserted in the food container 200.

Figure 4A:
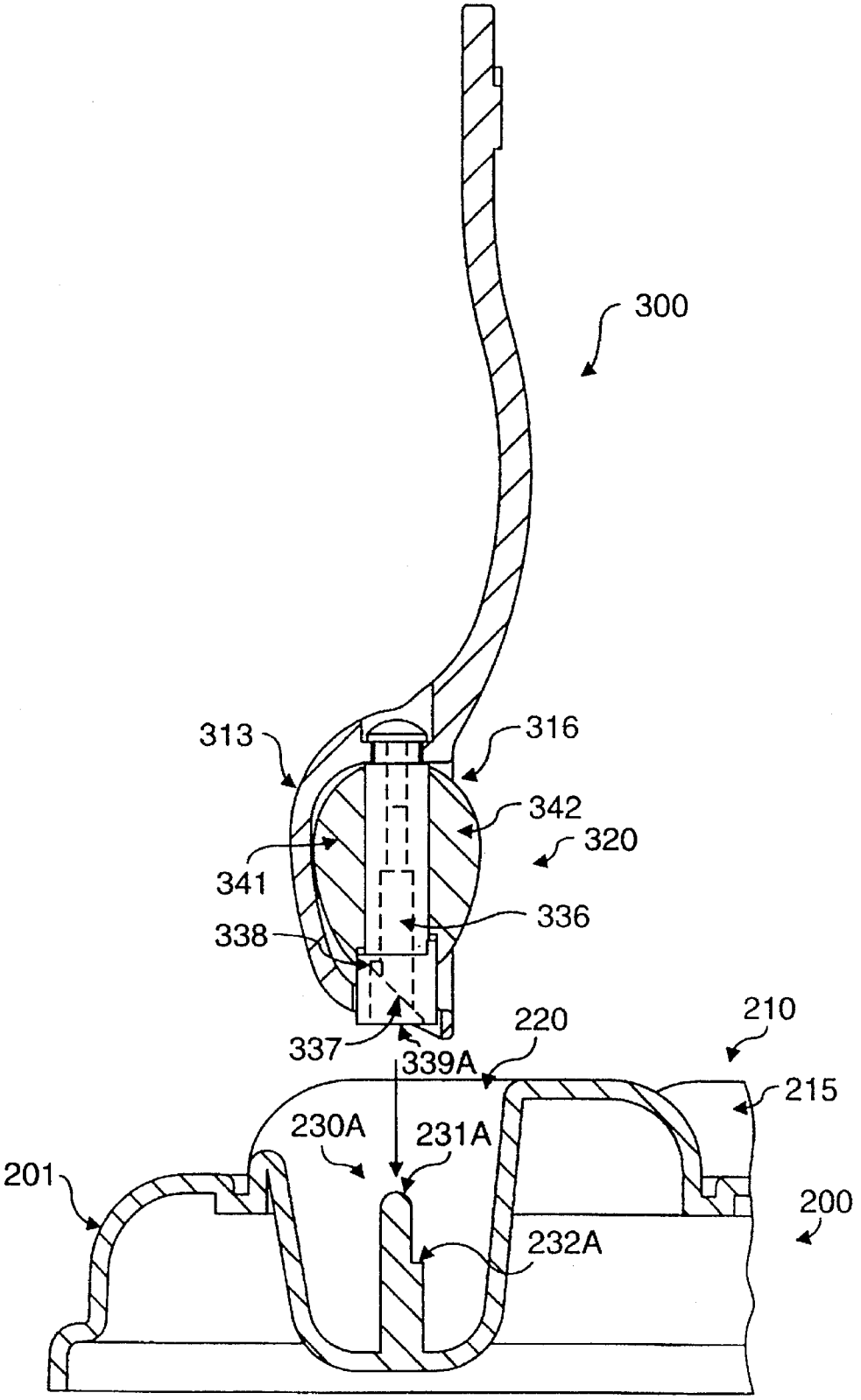
FIGS. 4A–E are elevational cross-sectional views of the food container and the spoon assembly shown in various stages of their interaction, from insertion of the spoon assembly into the food container through removal of the spoon assembly from the food container.

The operating sequence for rotating the spindle 320 through operative engagement with the cam assembly is shown in FIGS. 4A–4E. FIG. 4A shows the spoon assembly 300 as it is about to be inserted into spoon recess 220 of food compartment 210. Displayed in the food viewing opening 316 is food region 342, representing carrots. Therefore, since food compartment 210 contains simulated food 215, peas, the food viewing opening 316 does not display the proper food type upon insertion. Because the proper food type is not displayed, when the spindle 320 is brought into operative engagement with the cam assembly 230A, the cam receiving notch 338 in the cam follower surface 337 will not be in alignment to receive the cam 232A within it and therefore the cam follower surface 337 will engage the cam 232A to rotate the spindle 320 to a position where the cam receiving notch 338 will be positioned to receive cam 232A within it. When this positioning is achieved, the spindle 320 will have been rotated to its proper orientation so that the food region on the spindle 320 that is displayed within the food viewing opening 316 will be the same type of food that is contained within the food compartment into which the spindle 320 was inserted. This operating sequence is shown in FIGS. 4B–4E.

Figure 4B:
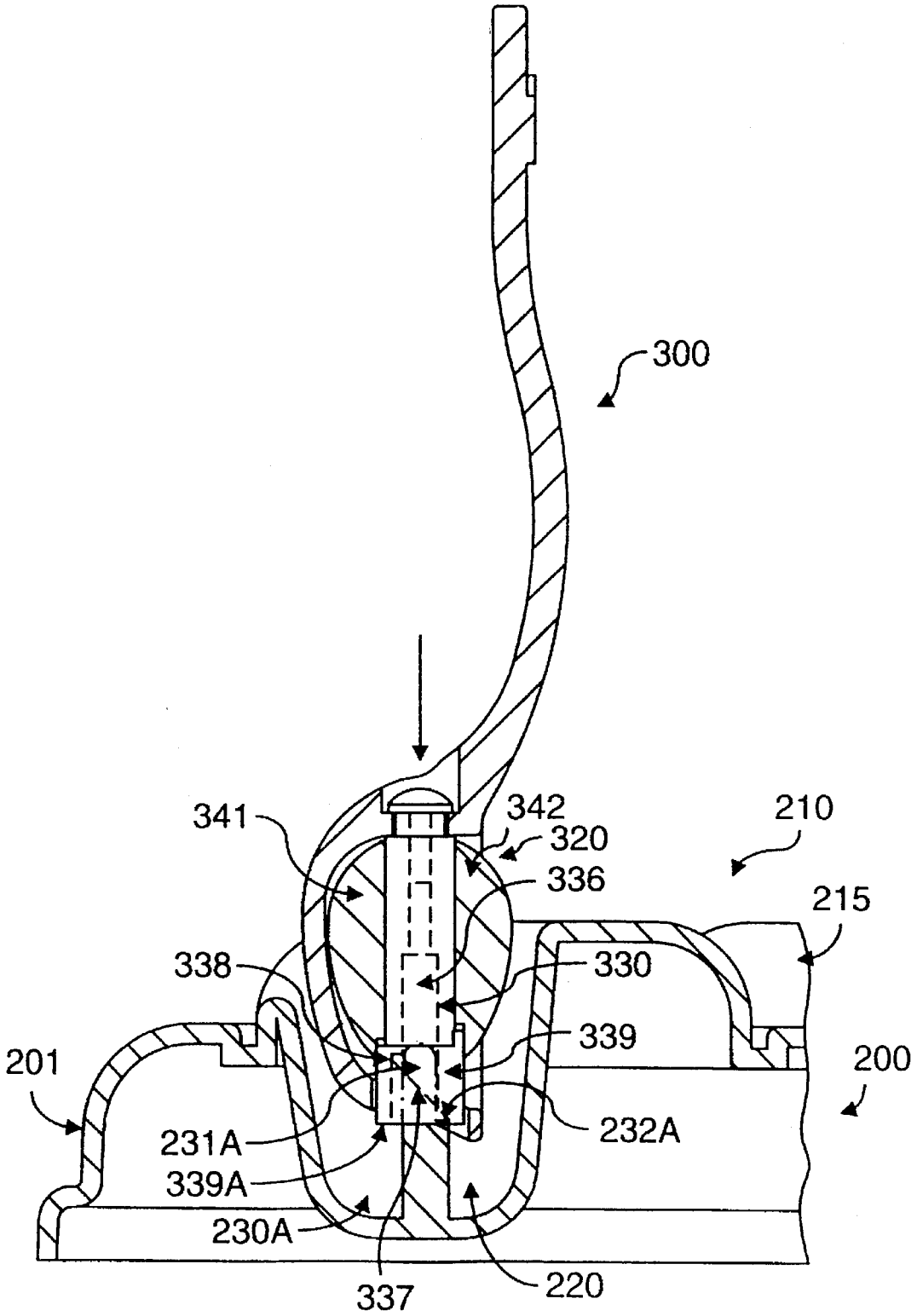

Continuing with the description of the operating sequence, where upon insertion of the spoon assembly 300 into spoon recess 220 the cam receiving notch 338 is not aligned with the cam 232A, FIG. 4B shows the spoon assembly 300 coming into first contact with the cam assembly 230A. As the spoon assembly 300 is lowered onto the cam assembly 230A, the cam guide 231A is inserted into the cam receiving aperture 339A of the spindle core 330, where the cam guide 231A passes through the cam receiving bore 339 and into the cam guide receiving bore 336. This mating between the cam guide 231A and the cam guide receiving bore 336 provides for positive alignment of the spindle 320 and the cam assembly 230A within the spoon recess 220. As the spindle 320 is lowered onto the cam assembly 230A, cam follower surface 337 of the spindle core 330 engages cam 232A.

Figure 4C:
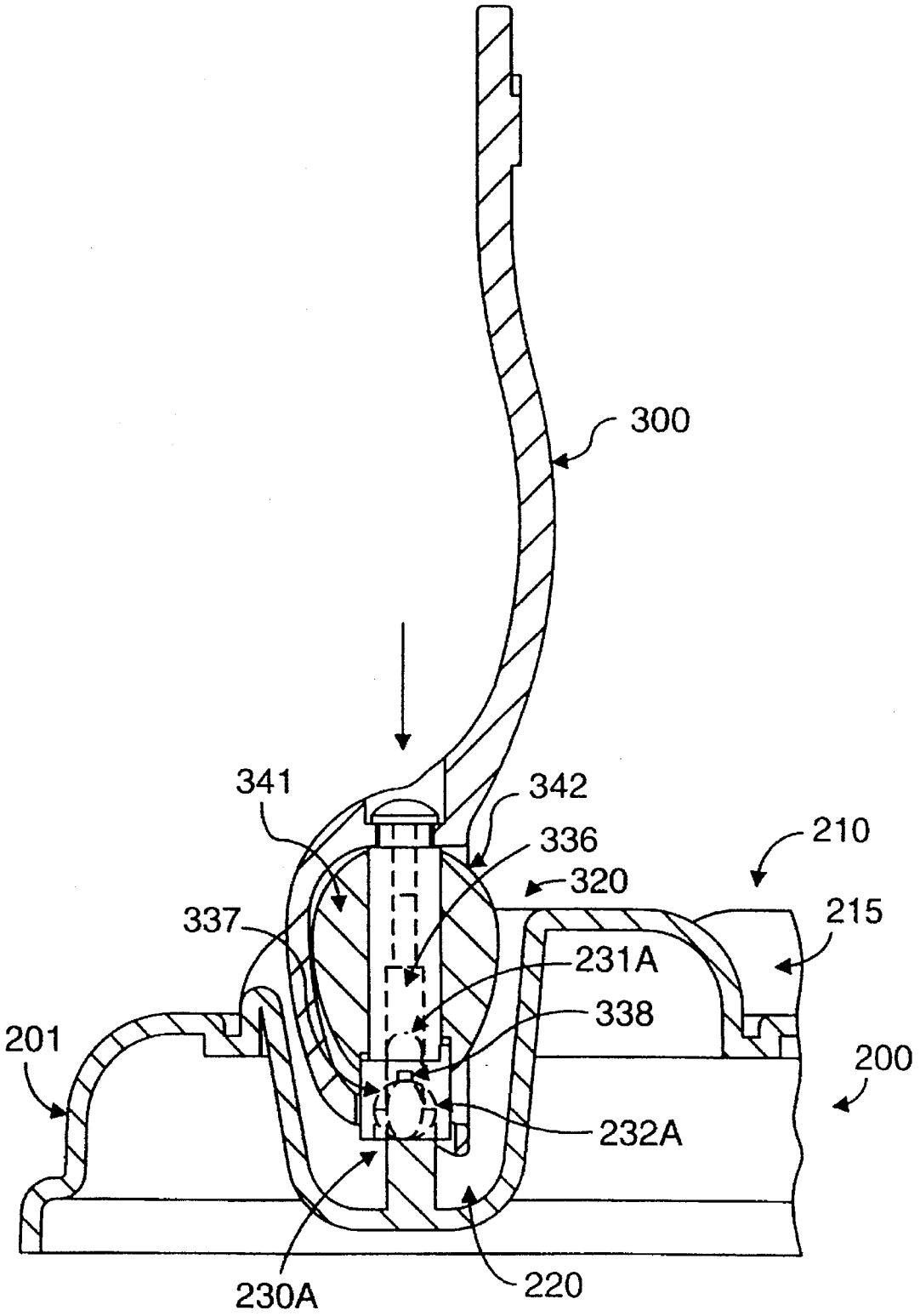

FIG. 4C shows the spindle 320 beginning to rotate due to interaction of the cam follower surface 337 with the cam 232A as downward pressure continues to be applied to the spoon assembly 300. In FIG. 4C, the spindle 320 has been rotated from its original orientation upon insertion into the spoon recess 220.

Figure 4D:
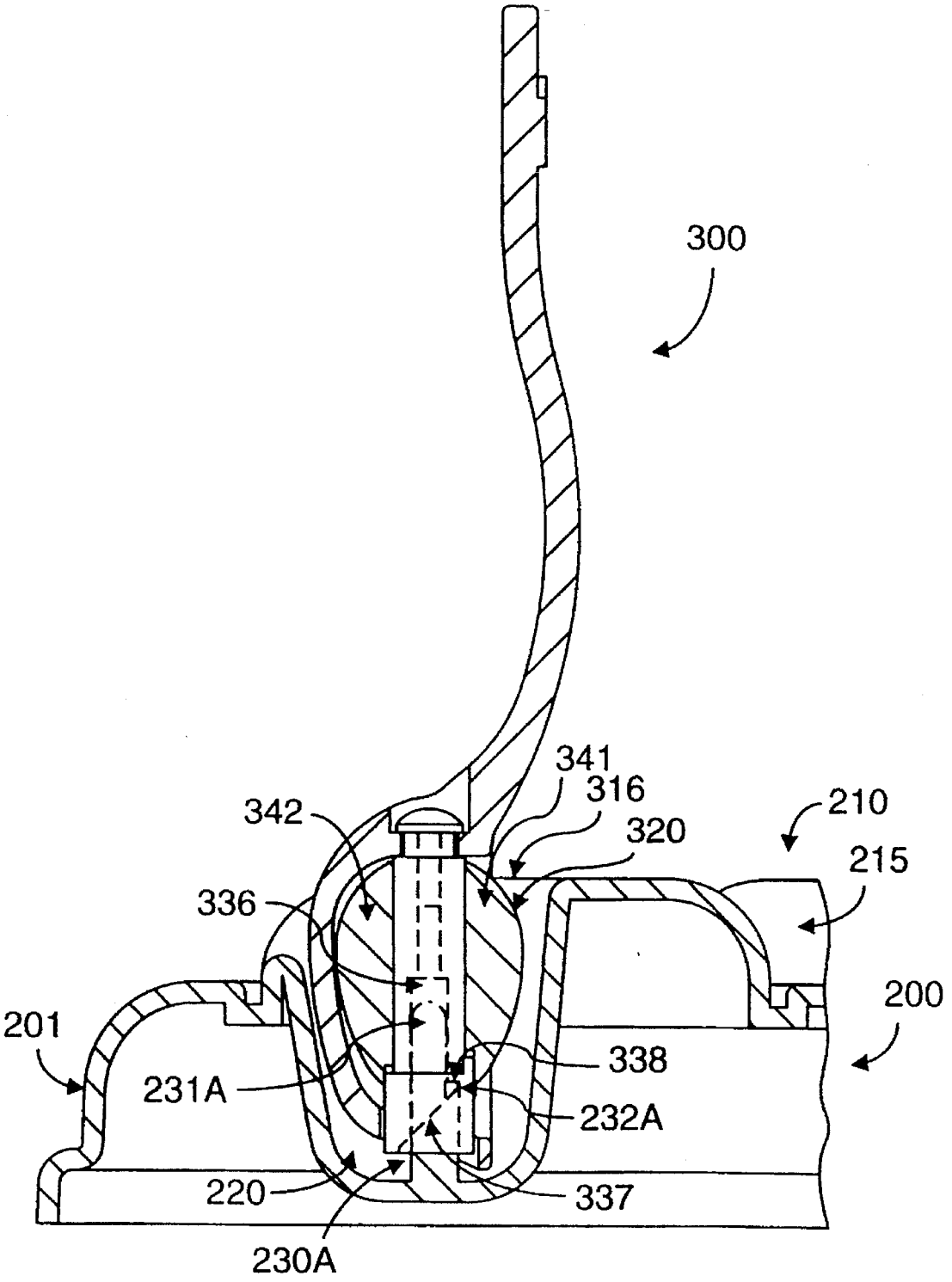
Figure 4E:
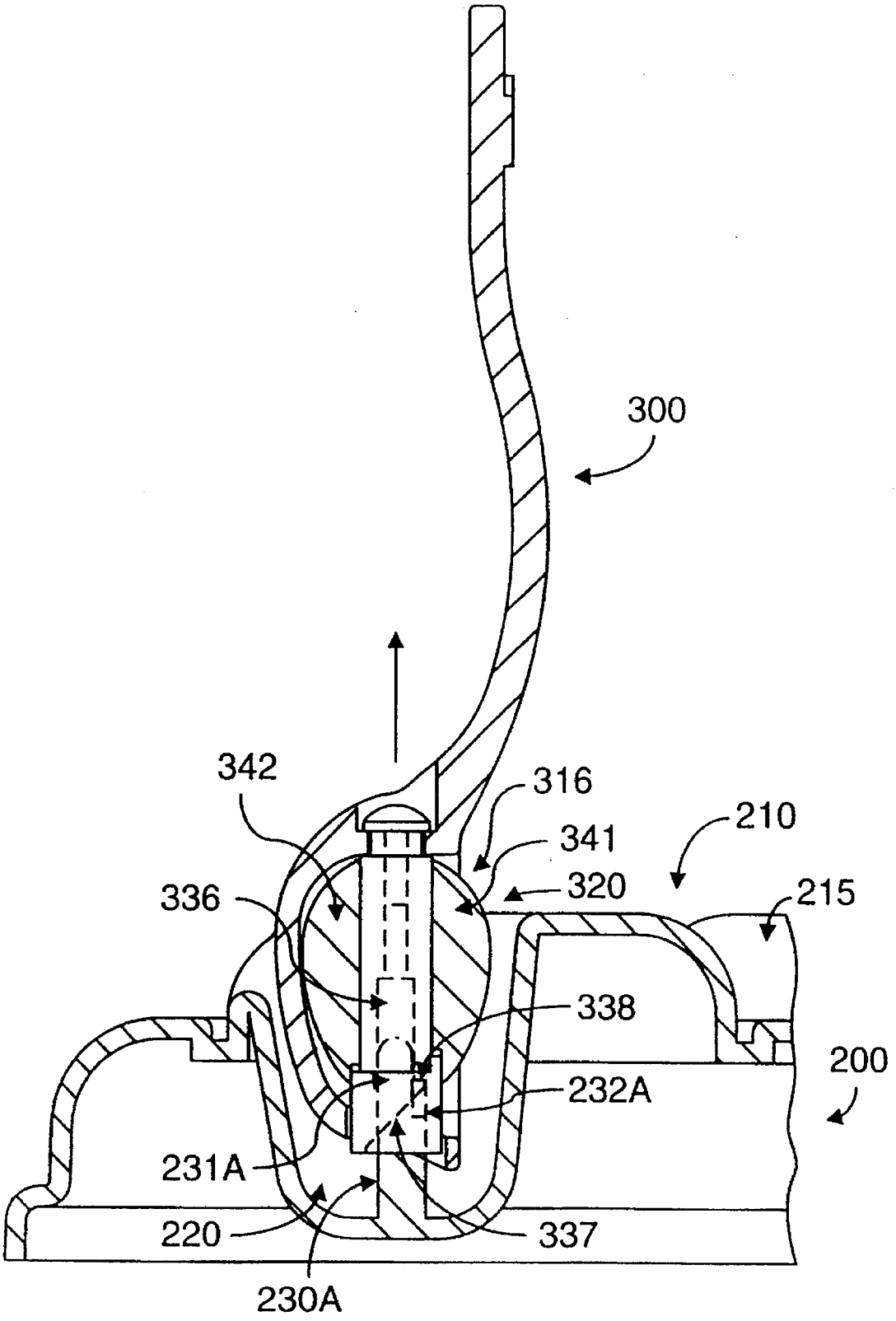

FIG. 4D shows the spindle 320 fully rotated so that cam 232A is now seated within cam receiving notch 338 of the cam follower surface 337, thus preventing further rotation of the spindle 320. In this spindle orientation, as discussed previously, the food region now appearing in the food viewing opening 316 is food region 341, representing peas, which is the same food type that appears in food compartment 210, into which the spoon assembly 300 has been inserted. It should be clear from the above description that if spoon assembly 300, with food region 341, representing peas, appearing in the food viewing opening 316, is inserted into food compartment 210, which also contains simulated food 215, peas, then no rotation of the spindle 320 would occur since cam receiving notch 338 of the cam follower surface 337 would receive cam 232A within it immediately upon insertion. FIG. 4E shows the spoon assembly 300 being removed from the spoon recess 220, with food region 341 now appearing in the food viewing opening 316, which is the same food type, namely peas, that is contained within food compartment 210.

In this manner, a child who is playing with the present invention can simulate placing a spoon into a food container that contains a variety of different food types and, regardless of which food type the spoon is placed into, upon removing the spoon from the food container, the spoon will appear to contain a portion of the food that the spoon was placed into.

In the disclosed embodiment, all of the components, except fastener 323, are comprised of injection molded plastic. Food container 200 is comprised of high impact polystyrene, spoon body 310 of polypropelene, and spindle core 330 of acetal. Spindle core 330 is comprised of acetal to in order to facilitate the rotational movement of the spindle core about the cam assembly. Spoon body 310 is molded in one piece, as is container 200. The simulated food on the container and on the food cylinder is visually simulated by molded-in surface texturing and by coloring. The color is applied by spray painting. It will be apparent to the artisan that other materials may be selected consistent with considerations of material and manufacturing cost, durability, and safety.

Several variations on the disclosed embodiment are contemplated. Although three separate foods are disclosed, a different number could be used. For example, a single food could be used, with one side of the food cylinder representing the food and the opposite side representing an empty spoon. Alternatively, two, four, or more foods could be used. Although the food is represented by both color and texture, either technique may be used without the other, provided that the foods are visually (or tactilely, for children with impaired vision) distinguished.

Although the food in the container is disclosed as being integrally molded with the container, it could be formed separately, such as by forming it as an insert to the container. This could further provide greater variety for the child by supplying more food inserts than compartments, with corresponding interchangeable food cylinders.

Although the spindle is shown as rotating about an axis parallel to the longitudinal axis of the spoon, it could also be mounted for rotation about other axes, or for translation along various axes, provided that different foods are displayable in the food viewing opening. Similarly, although the mechanism disclosed for moving the spindle to display the different food regions is a cam and cam follower combination, other actuating mechanisms, such as those described in the Background section above, may be used.

What is claimed is:

1. A spoon for simulating the feeding of multiple foods to a baby doll, comprising:

a bowl having a food viewing opening therein;

a handle coupled to said bowl; and a spindle mounted within said bowl for rotation with respect to said bowl between a first spindle position and a second spindle position, said spindle having an outer surface that is divided into first and second regions, each of said first and second regions being visually distinct from the other, and simulating first and second foods, respectively, said first region being visible in said food viewing opening and said second region being obscured when said spindle is in said first spindle position and said first region being obscured and said second region being visible in said food viewing opening when said spindle is in said second spindle position.

2. The spoon of claim 1 wherein said spindle rotates about an axis approximately parallel to a longitudinal axis of said spoon.

3. The spoon of claim 1 wherein:

said spindle is further rotatable with respect to said bowl to a third spindle position between said first and second spindle positions; and said outer surface of said spindle is further divided into a third region disposed between said first and second regions, said third region being visually distinct from said first and second regions and simulating a third food, said third region being visible in said food viewing opening and said first and second regions being obscured when said spindle is in said third spindle position.

4. The spoon of claim 1 wherein said first and second regions are visually distinguished by color.

5. The spoon of claim 1 wherein said first and second regions are visually distinguished by texture.

6. In combination with the spoon of claim 1, a food container having:

a first container region visually simulating said first food;

means, disposed on said food container, for engaging said spindle and urging said spindle to said first spindle position when said bowl is proximate to said first container region.

7. The spoon and container of claim 6 wherein:

said means for urging said spindle to said first spindle position comprises a cam follower coupled to said spindle and a first cam operably engageable with said cam follower and disposed in said first container region, engagement of said cam follower and said cam urging said spindle into said first spindle position.

8. An apparatus for simulating the feeding of a variety of food types to a baby doll, comprising:

a spoon assembly having:

a bowl having a food viewing opening therein;

a handle coupled to said bowl;

a spindle rotatably mounted within said bowl and having an outer surface having a first spindle region, said first spindle region visually simulating a first food, said spindle being rotatable about a spindle rotation axis between a first spindle position in which said first spindle region is visible in said food viewing opening and a second spindle position in which said first region is obscured;

a cam follower coupled to said spindle;

a food container having:

a first container region visually simulating said first food; and a first cam operably engageable with said cam follower and disposed on said food container so that when said cam follower is in engagement with said first cam, said bowl is proximate to said first container region, engagement of said cam follower and said first cam urging said spindle into said first spindle position.

9. The apparatus of claim 8 wherein:

said outer surface of said spindle has a second spindle region visually simulating a second food, visually distinct from said first food, said second spindle region being visible in said food viewing opening when said spindle is in said second spindle position;

said container further includes a second container region visually simulating said second food and a second cam operably engageable with said cam follower and disposed on said food container so that when said cam follower is in engagement with said second cam, said bowl is proximate to said second container region, engagement of said cam follower and said second cam urging said spindle into said second spindle position.

10. The apparatus of claim 9 wherein:

said food container includes a first spoon recess disposed in said first container region, said first spoon recess being configured to receive said bowl in a predetermined orientation with respect to said container, said first cam being disposed in first spoon recess.

11. The apparatus of claim 10 wherein:

said food container further includes a second spoon recess having substantially the same configuration as said first spoon recess, said second cam being disposed in said second spoon recess, said first cam and said second cam being disposed with different angular orientations with respect to their respective spoon recesses.

12. A method for simulating the feeding of a variety of food types to a baby doll comprising the steps of:

disposing a spindle for rotational movement in the bowl of a spoon, the outer surface of said spindle being divided into first and second regions, said first and second regions being visually distinct from the other and simulating first and second foods, respectively;

disposing first and second container regions on a container, said container regions simulating said first and second foods, respectively;

bringing said spoon bowl into operative engagement with said first container region;

rotating said spindle to said first position to display said first food region;

disengaging said spoon from said first container region;

bringing said spoon into operative engagement with said second container region;

rotating said spindle to said second position to display said second food region; and disengaging said spoon from said second container region.

13. The method of claim 12 wherein:

said spindle includes a cam follower, said first container region includes a first cam, and said second container regions includes a second cam;

said step of rotating said spindle to said first position comprises engaging said cam follower with said first cam; and said step of rotating said spindle to said second position comprises engaging said cam follower with said second cam.

14. The method of claim 12:

wherein said spindle further comprises a third region simulating a third food and is rotatable to a third spindle position; and further comprising the steps of:

disposing a third container region on said container, said third container region simulating said third food;

bringing said spoon into operative engagement with said third container region;

rotating said spindle to said third spindle position to display said third food region; and disengaging said spoon from said third container region.

* * * * *